United States Patent [19]

Pfarrwaller

[11] 4,273,163

[45] Jun. 16, 1981

[54] FABRIC TAKE-OFF DEVICE

[75] Inventor: Erwin Pfarrwaller, Winterthur, Switzerland

[73] Assignee: Sulzer Brothers Limited, Winterthur, Switzerland

[21] Appl. No.: 3,901

[22] Filed: Jan. 16, 1979

[30] Foreign Application Priority Data

Jan. 19, 1978 [CH] Switzerland ..... 498/78

[51] Int. Cl.[3] ..... D03D 49/20

[52] U.S. Cl. ..... 139/308; 66/149 R

[58] Field of Search ..... 139/304, 307, 308, 149; 66/149 R; 242/65, 66

[56] References Cited

U.S. PATENT DOCUMENTS

| | | | |
|---|---|---|---|
| 1,957,024 | 5/1932 | Klemm | 139/149 |
| 3,645,300 | 2/1972 | Geven et al. | 139/308 |
| 3,698,446 | 10/1972 | Miller et al. | 66/149 R |
| 3,910,319 | 10/1975 | Bassing et al. | 139/308 |
| 4,027,506 | 6/1977 | Bitzer | 139/304 |

FOREIGN PATENT DOCUMENTS

| | | | |
|---|---|---|---|
| 694459 | 9/1930 | France | 139/304 |

*Primary Examiner*—Henry Jaudon

*Attorney, Agent, or Firm*—Kenyon & Kenyon

[57] ABSTRACT

The fabric take-off device comprises a fabric take-off roller mounted to be movable transversely of its longitudinal axis and two associated rod-shaped fabric guide elements which are mounted on fixed axes for supplying the fabric to the take-off roller and for taking the fabric away from the roller. The fabric tension causes the take-off roller to be pressed against the two guide elements due to the movable mounting of the roller. This contact-pressure force increases automatically as the cloth tension increases. A very reliable fabric take-off is obtained without slipping of the fabric on the take-off roller. To avoid damage to the fabric, the take-off roller need not have a rough surface nor need any pins, but may have a relatively smooth surface made, for example, of plastics.

16 Claims, 6 Drawing Figures

FABRIC TAKE-OFF DEVICE

This invention relates to a fabric take-off device. More particularly, this invention relates to a fabric take-off device for a travelling web of fabric on a textile machine.

Heretofore, it has been known to provide various types of textile machines such as weaving machines with fabric or cloth take-off devices. Generally, the take-off device is comprised of a driven take-off roller and a pair of rod-shaped guide elements disposed to either side of the take-off roller. As described in German Pat. No. 24 30302, the take-off roller is usually mounted in a stationary manner in the frame of the machine while the two guide rollers are spaced apart.

However, one disadvantage of the known construction is that the periphery of the fabric take-off roller must have a very rough coating, for example a coating of corrundum, or must have pins to prevent the fabric from slipping on the roller. Such rough surfaces or pins generally are undesirable for sensitive fabrics such as nylon or glass fiber fabrics as well as for very heavy fabrics which require a considerable take-off force because they may damage the fabric. For example, the weft yarns of a fabric may be displaced such that stripes are formed in the fabric. Where pins are used on the periphery of the fabric take-off roller, visible holes may occur in the fabric.

Accordingly, it is an object of the invention to provide a fabric take-off device which does not require rough coatings or pins.

It is another object of the invention to provide a take-off device for a textile machine which is incapable of punching holes in a fabric.

It is another object of the invention to provide a take-off device which can reliably take-off a fabric from a weaving machine in a smooth reliable manner.

Briefly, the invention provides a fabric take-off device for a travelling web of fabric which is comprised of a pair of longitudinally elongated guide elements and a take-off roller. The guide elements are disposed in spaced relation to each other to define a gap of predetermined size and each is disposed on a fixed longitudinal axis for passage of the travelling web thereover. The take-off roller is of a diameter greater than the size of the gap between the two guide elements and is disposed between the guide elements relative to the travelling web for passage of the web thereover. In addition, the roller is drivingly rotatable about a longitudinal axis thereof while being freely movable transversely of this axis.

During operation, the fabric take-off roller can be automatically pulled by the fabric itself against the guide elements with increasing force, the greater the fabric tension. As a result, the fabric take-off is very reliable and slip-free. Experiments have shown that even with sensitive and heavy cloths such as glass fiber, nylon and heavy denim fabrics, the fabric take-off roller can have just the standard relatively smooth and possibly slightly elastic surface coating. The fabric does not slip and cannot be damaged by excessively rough surfaces or a surface having pins therein.

In order to permit the rotation and transverse movement of the take-off roller, a suitable joint is located between the take-off roller and a transmission which serves to effect rotation of the roller.

The guide elements can be mounted on a common support and may be freely rotatable or fixedly mounted. The support may be of U-shape to define a pair of arms with a guide element disposed on each respective arm as well as a recess between the arms with the take-off roller disposed between the arms. In addition, an elongated bar may be disposed in abutment with the roller while a force-storage means biases the bar towards the roller in order to take-up the weight of the roller.

These and other objects and advantages of the invention will become more apparent from the following detailed description taken in conjunction with the accompanying drawings wherein.

Figure 1:
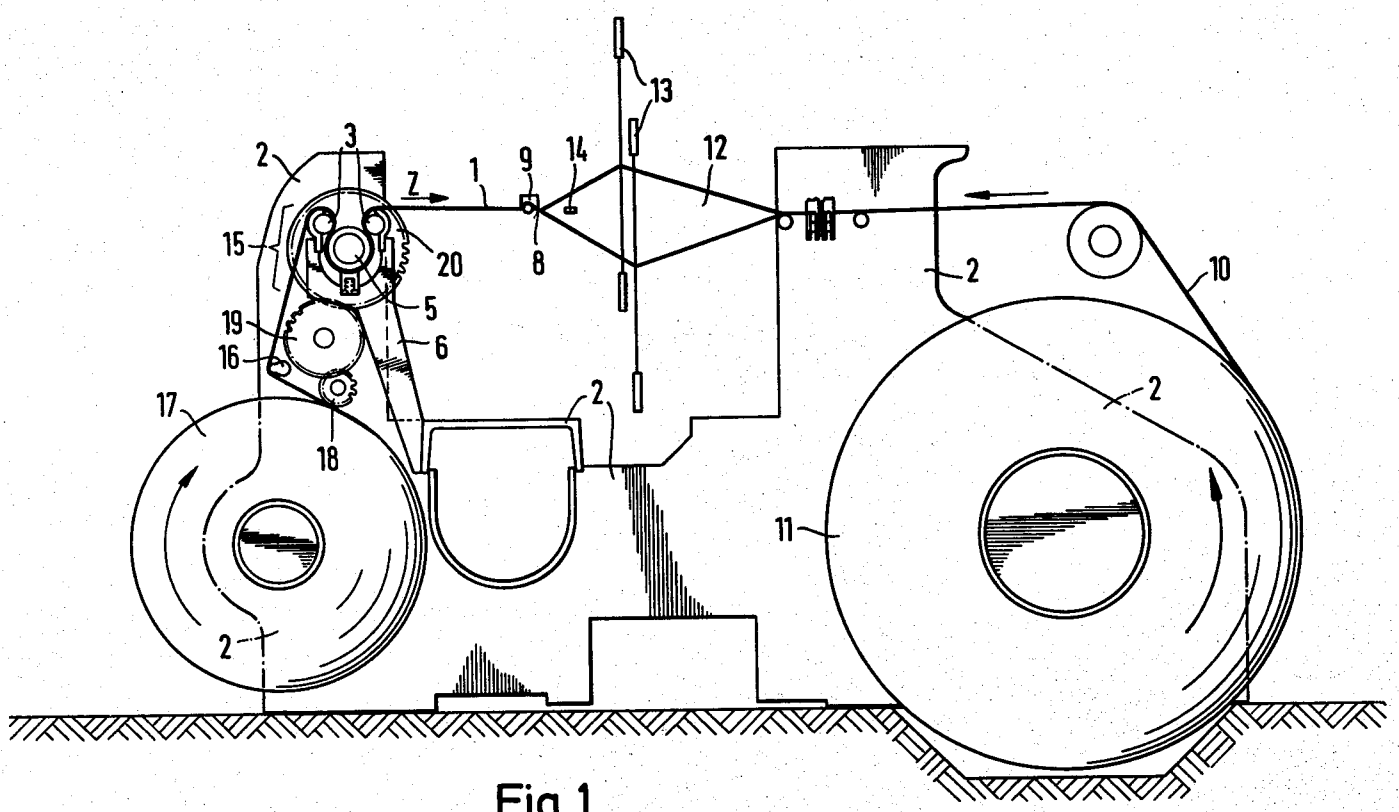
FIG. 1 illustrates a diagrammatic side elevational view of a weaving machine employing a take-off device in accordance with the invention.

Referring to FIG. 1, the textile machine, which is in the form of a weaving machine of conventional structure has a frame 2 on which a warp beam 11 is mounted to deliver a plurality of warps 10 into a means for forming a shed 12 having a read beat-up point 8 at one end. As indicated, this means includes a plurality of healds 13 which separate the warps 10 into the shed. In addition, suitable means are provided for introducing a gripper projectile 14 into the shed 12 for beating up of a weft yarn (not shown) at the beat-up point 8 to form a fabric or cloth 1. The machine also has a temple 9 through which the fabric 1 passes from the beat-up point 8, a fabric take-off device 15, a guide bar 16 and a fabric or cloth beam 17 upon which the cloth is wound.

Figure 2:
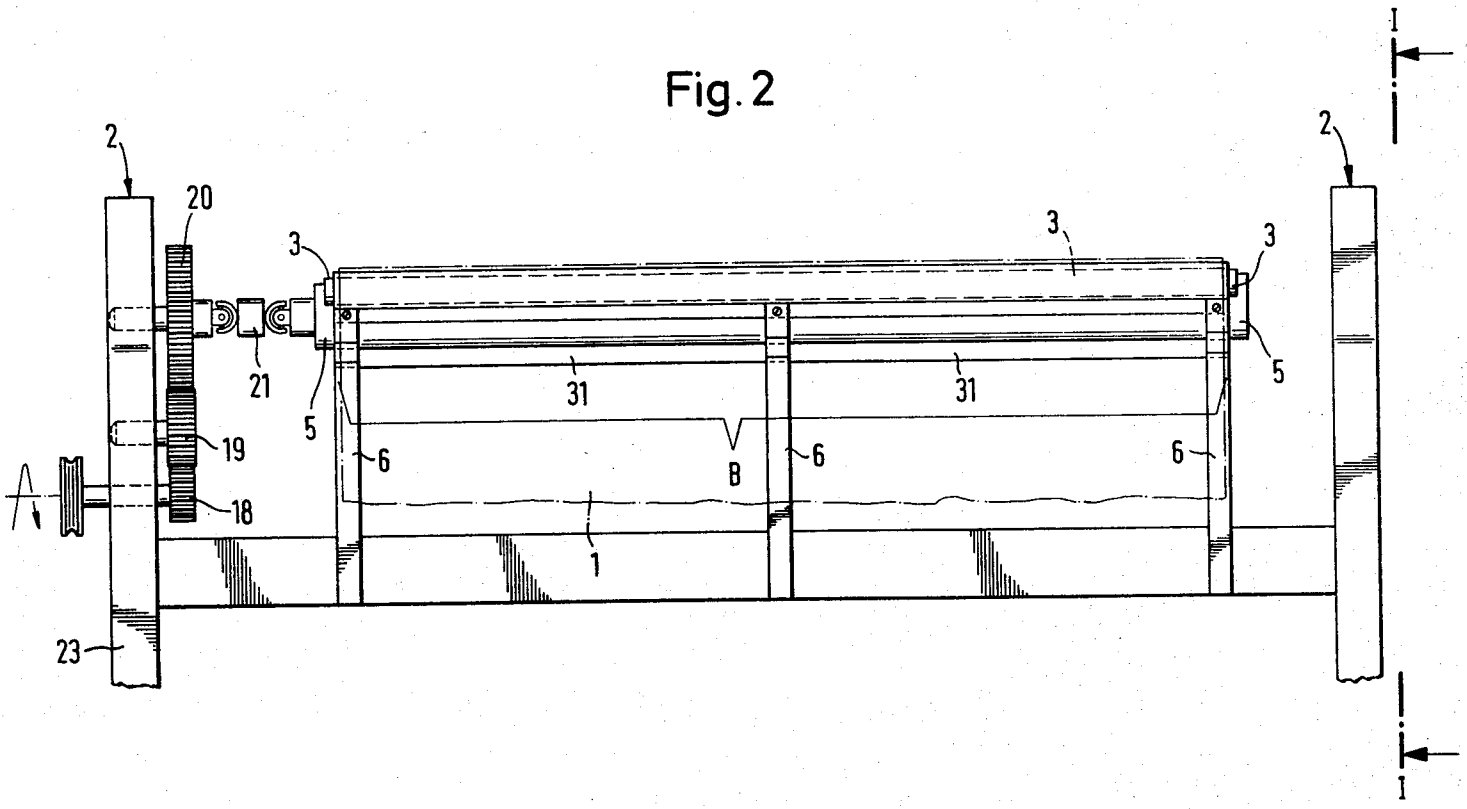
FIG. 2 illustrates a diagrammatic front view of the weaving machine of FIG. 1 as taken from the fabric end.
Figure 3:
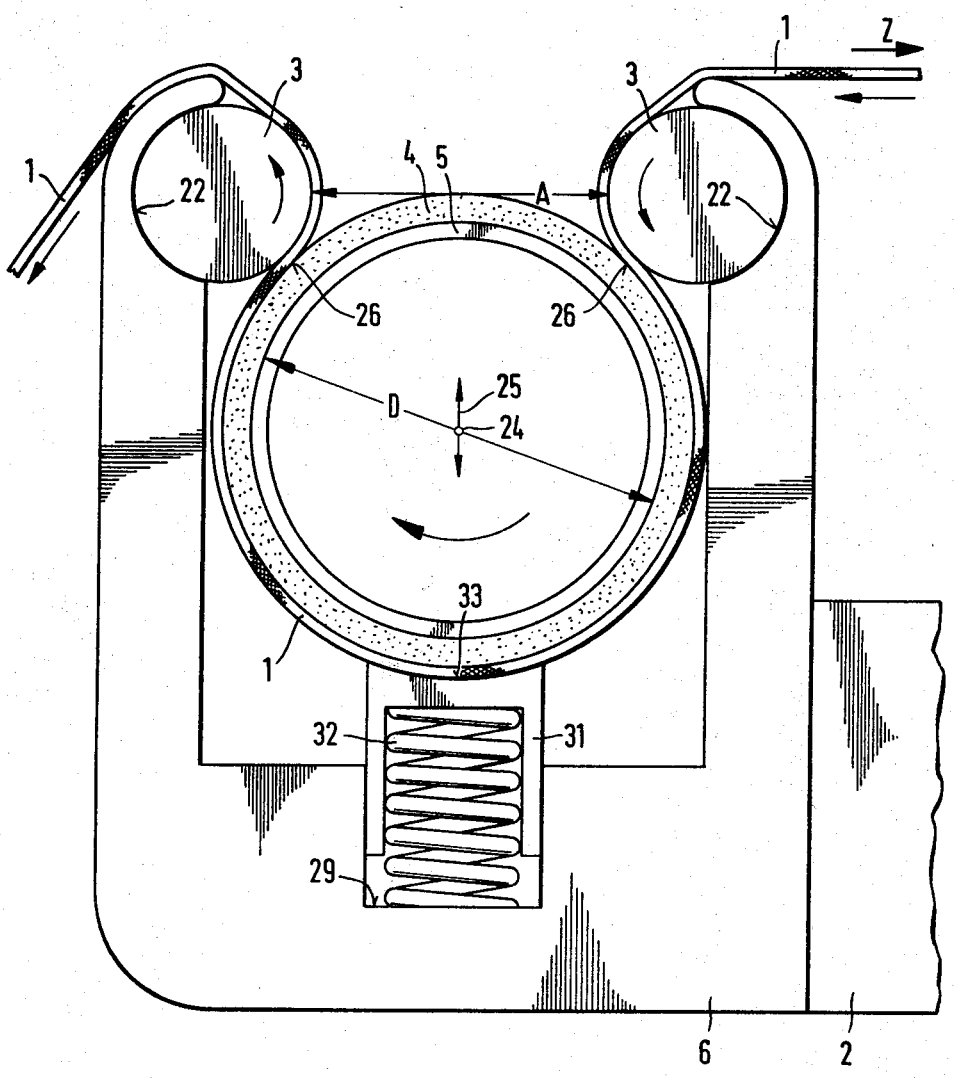
FIG. 3 illustrates a cross-sectional view of a take-off device in accordance with the invention.

Referring to FIGS. 1 and 3, the fabric take-off device 15 is comprised of a fabric take-off roller 5 and two guide elements, such as rollers 3 which are mounted via supports 6 on the frame 2. As shown in FIG. 2, each of the rollers 3, 5 extends across the entire weaving width B of the machine.

Referring to FIGS. 1 and 2, a transmission for driving the take-off roller 5 includes a pinion 18 and two gear wheels 19, 20 which are mounted on the frame 2 and driven off a main shaft (not shown) of the machine. As indicated, the pinion 18 receives a driving force from the main shaft via a pulley wheel. In addition, a joint, such as a cardan or ball joint 21, is disposed between the gear wheel 20 and the take-off roller 5 (see FIG. 2) in order to positively rotate the take-off roller 5 directly from the main shaft while allowing transverse movements of the roller 5.

As indicated in FIG. 2, the common supports 6 are disposed along the entire width of the guide rollers 3. Also, as shown in FIG. 3, each support 6 is of U-shape to define a pair of arms and a recess between the arms. Each guide roller 3 is supported in a fixed position in a recess 22 of a respective arm of the support 6 and is rotatable only about its own longitudinal axis. The take-off roller 5 is disposed in the recess 29 between the arms on a longitudinal axis 24 and is movable transversely (e.g. vertically) of the axis 24 as indicated by the arrows 25 with a small clearance with the arms. The take-off roller 5 has no axial bearing and forms a nip point 26 with each guide roller 3 during operation. The joint 21 which is located between the take-off roller 5 and transmission permits the transverse movement of the roller 5.

The guide rollers 3 are disposed in spaced parallel relation to each other to define a gap A of predetermined size while the fabric take-off roller 5 has a diameter which is greater than the size of the gap A. In this way, the freedom of movement of the roller 5 transversely of the axis 24 is limited. As shown in FIG. 3, the take-off roller 5 has a surface 4 which may, for example, be made of plastics.

The movement of the take-off roller 5 transversely of the axis 24 is obtained from the fabric tension Z produced by the fabric 1. This tension is directed in opposition to the direction of movement of the fabric and causes the roller 5 to be pressed uniformly and intensively against the guide rollers 3 over the entire length of the roller 5 at the common nip points 26. The greater the fabric tension Z the greater the contact pressure forces at the nip points 26. This prevents the fabric 1 from slipping on the surface 4 of the roller 5.

Referring to FIG. 3, an elongated bar 31 is accommodated in the recess 29 of each support 6 in abutment with the roller 5 while a force-storage means 32 biases the bar 31 towards the roller 5. As shown, the bar is of U-shaped cross-section and a plurality of springs 32 are spaced along the width of the weaving machine to bias the bar upwardly. The bar 31 also has a trough-shaped surface 33 at the top to match the surface of the roller 5. During operation, this surface 33 is pressed against the roller 5 by the springs 32. The weight of the roller 5 can thus be taken up by the bar 31 and an additional contact pressure can be produced at the nip points 26. The cloth drive is thus insured even if the cloth tension temporarily lapses.

As indicated in FIG. 3, the cloth 1 passes between the roller 5 and the matching surface 33 of the bar 31. To this end, the bar 31 is suitably constructed so as to avoid any sharp edges coming in contact with the fabric 1.

Figure 4:
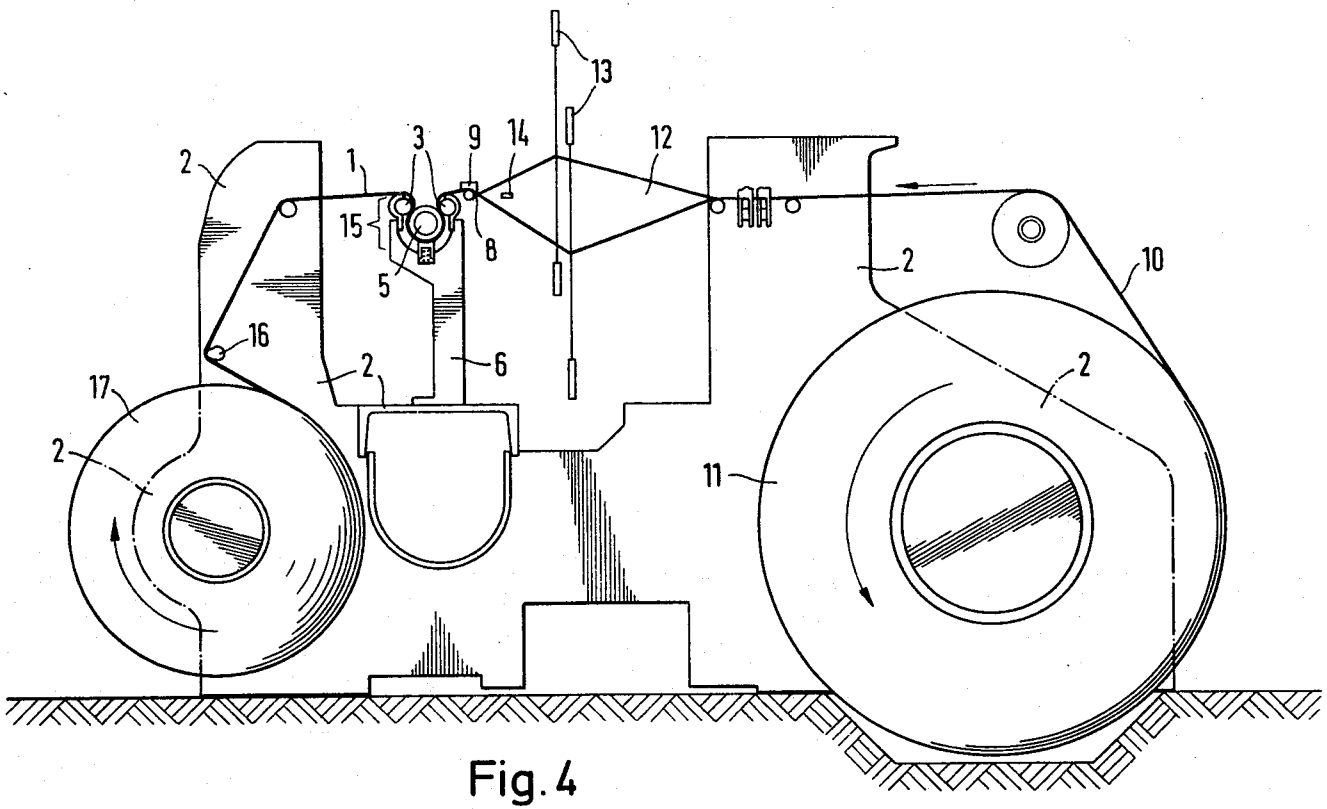
FIG. 4 illustrates a diagrammatic side elevational view of a weaving machine having a take-off device in accordance with the invention adjacent to a temple.

Referring to FIG. 4, wherein like reference characters indicate like parts as above, the fabric take-off device may be disposed immediately after the beat-up point 8 and the temple 9 as considered in the direction of the movement of the cloth 1 rather than in spaced relation as illustrated in FIG. 1.

Figure 5:
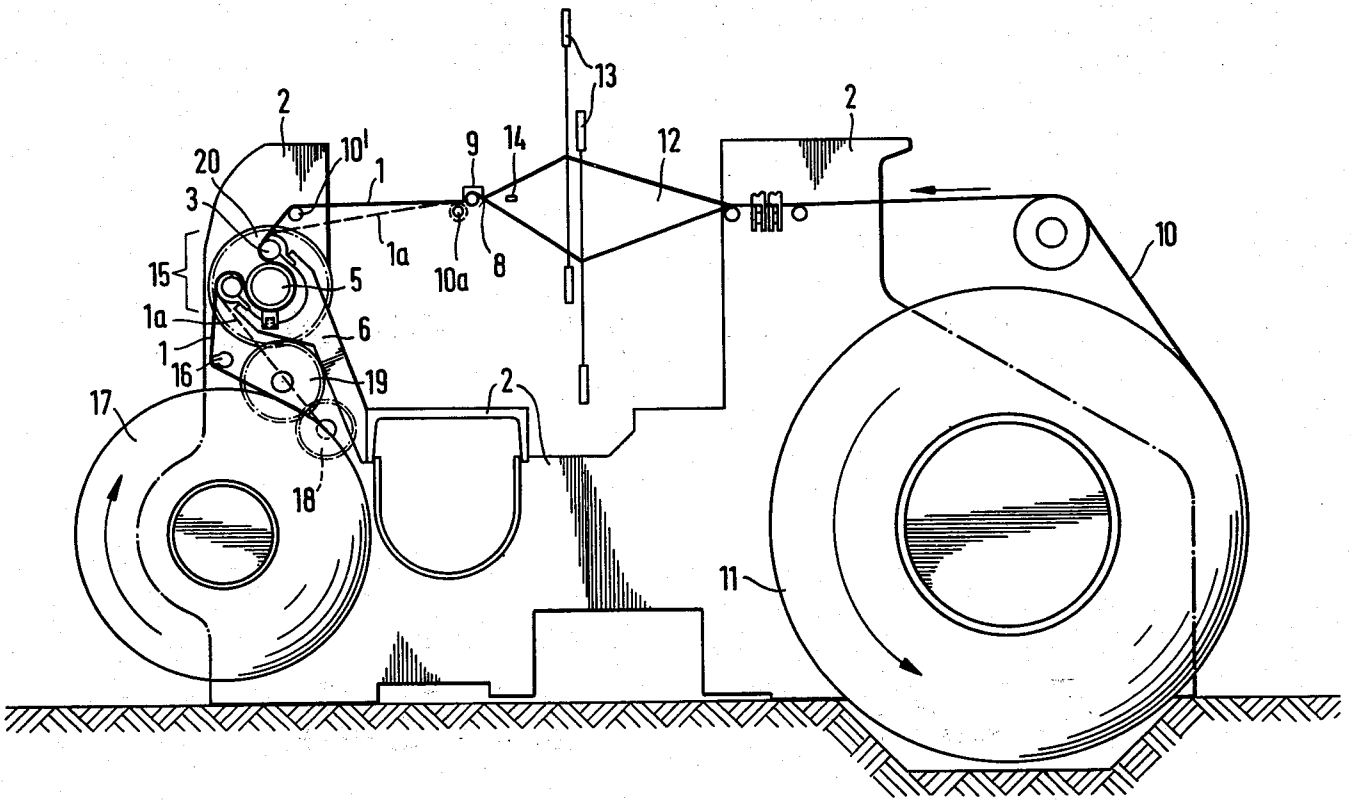
FIG. 5 illustrates a diagrammatic side elevational view of a weaving machine employing a take-off device in accordance with the invention which is disposed at an angle to the horizontal.

Referring to FIG. 5, wherein like reference characters indicate like parts as above, the take-off device 15 may also be disposed at an angle to the horizontal plane. In this case, the fabric 1 is fed to the take-off device via one or more guide rollers 10 disposed between the beat-up point 8 and the take-off device 15. In a further modified embodiment, one guide roller 10*a* may be disposed at the temple 9 for guiding the fabric 1 in the direction indicated by the broken line path 1*a* towards the take-off device 15. In either case, the rollers 10, 10*a* may be in the form of opposed-pitch screw-threaded rotatably mounted rods in order to laterally stretch the fabric and thus keep the fabric free from creases.

Because of the inclination, the take-off device 15 acts a further guide for the fabric 1 during passage to the cloth or fabric beam 17.

Figure 6:
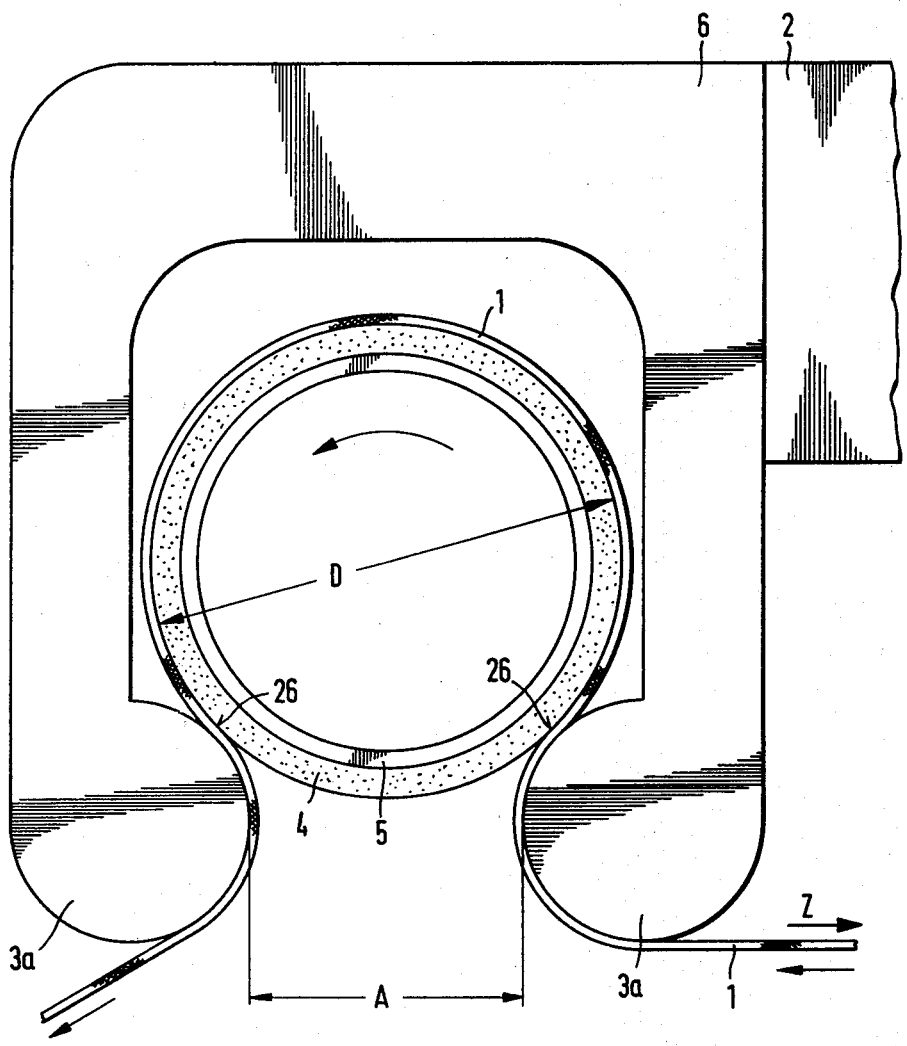
FIG. 6 illustrates a modified take-off device in accordance with the invention.

Referring to FIG. 6, wherein like reference characters indicate like parts as above, the take-off device may alternatively be constructed with guide elements which are fixedly mounted. In this case, the guide elements 3*a* are formed as the jaws of a support 6. In this case, the jaws 3*a* extend over the entire width of the fabric 1 spanning the distance between the spaced apart supports 6. As above, the fabric 1 passes over the jaws 3*a* in the manner as shown. In addition, the take-off roller 5 is situated above the jaws 3*a* so that the dead weight of the roller 5 can be taken by the jaws 3*a* to produce a contact pressure at the respective nip points 26 even if the fabric tension is temporarily absent.

It is to be noted that the guide elements 3 of FIGS. 1 to 5 have no drive and are therefore driven or rotated simply by the movement of the fabric 1. In FIG. 6, the guide elements 3*a* are disposed in a fixed manner as parts of the support 6 so that the fabric 1 slides over the elements 3*a*. These guide elements 3*a* are therefore "drive-less".

It is also to be noted that the take-off device can be used on other types of textile machinery, for example in machinery used for fabric finishing.

What is claimed is:

1. A fabric take-off device for a travelling web of a fabric, said device comprising a plurality of supports disposed across a given weaving width;

a pair of longitudinally elongated guide elements mounted on said supports in spaced relation to each other to define a gap of predetermined size therebetween, each said element extending across said weaving width on a fixed longitudinal axis for passage of the travelling web therearound with at least the upstream guide element being driveless; and a take-off roller of a diameter greater than said size of said gap disposed between said guide elements relative to the travelling web for passage of the travelling web thereover, said roller being drivingly rotatable about a longitudinal axis thereof and freely movable transversely of said latter axis to define a nip with each said guide element for passage of the web therebetween.

2. A fabric take-off device as set forth in claim 1 wherein said take-off roller includes a joint at one end for connection to a drive to permit transverse movement of said roller.

3. A fabric take-off device as set forth in claim 1 which further comprises at least one common support having said guide elements mounted thereon.

4. A fabric take-off device as set forth in claim 1 wherein each support is of U-shape to define a pair of arms with one of said guide elements disposed on a respective arm and a recess between said arms with said roller disposed in said recess between said arms.

5. A fabric take-off device as set forth in claim 1 wherein each guide element is mounted for rotation in said supports.

6. A fabric take-off device as set forth in claim 1 wherein said take-off roller is disposed above said guide elements.

7. A fabric take-off device as set forth in claim 1 which further comprises an elongated bar disposed in abutment with said roller and a force-storage means biasing said bar towards said roller.

8. In a textile machine, the combination comprising a machine frame having a given weaving width and a plurality of supports disposed along said weaving width;

a transmission mounted on said machine frame for receiving a driving force from a main shaft; and a fabric take-off device mounted on said machine frame, said device including a pair of drive-less elongated guide elements mounted on said supports in spaced relation to each other to define a gap of predetermined size therebetween, each said element extending across said weaving width on a fixed longitudinal axis for passage of a travelling web thereover, and a take-off roller of a diameter greater than said size of said gap disposed between said guide elements relative to the travelling web for passage of the travelling web thereover, said roller being connected to said transmission for rotation about a longitudinal axis thereof and for free movement transversely of said latter axis to define a nip with each said guide element for passage of the web therebetween.

9. A fabric take-off device as set forth in claim 8 wherein each said guide element is a roller disposed in a recess of a respective support.

10. The combination as set forth in claim 8 which further comprises a joint between said transmission and said roller to effect rotation of said roller and to permit transverse movements of said roller.

11. The combination as set forth in claim 8 which further comprises a means for forming a shed having a reed beat-up point at one end, and at least one guide roller for for the ravelling web between said beat-up point and said take-off device.

12. The combination as set forth in claim 11 wherein said guide roller is an opposed-pitch screw-threaded rotatably mounted rod for laterally stretching the travelling web.

13. The combination as set forth in claim 8 wherein said guide elements are freely rotatable.

14. The combination as set forth in claim 8 wherein said guide elements are fixedly mounted.

15. A fabric take-off device for a travelling web of a fabric, said device comprising a pair of longitudinally elongated guide elements disposed in spaced relation to each other to define a gap of predetermined size therebetween, each said element being disposed on a fixed longitudinal axis for passage of the travelling web thereover;

a take-off roller of a diameter greater than said size of said gap disposed between said guide elements relative to the travelling web for passage of the travelling web thereover, said roller being drivingly rotatable about a longitudinal axis thereof and freely movable transversely of said latter axis; and an elongated bar disposed in abutment with said roller and a force-storage means biasing said bar towards said roller.

16. In a textile machine, the combination comprising a machine frame;

a transmission mounted on said machine frame for receiving a driving force from a main shaft; and a fabric take-off device mounted on said machine frame, said device including a pair of fixedly mounted elongated guide elements disposed in spaced relation to each other to define a gap of predetermined size therebetween, each said element being disposed on a fixed longitudinal axis for passage of a travelling web thereover, and a take-off roller of a diameter greater than said size of said gap disposed between said guide elements relative to the travelling web for passage of the travelling web thereover, said roller being connected to said transmission for rotation about a longitudinal axis thereof and for free movement transversely of said latter axis to define a nip with each said guide element for passage of the web therebetween.

* * * * *

UNITED STATES PATENT AND TRADEMARK OFFICE

CERTIFICATE OF CORRECTION

PATENT NO. : 4,273,163

DATED : June 16, 1981

INVENTOR(S) : ERWIN PFARRWALLER

It is certified that error appears in the above—identified patent and that said Letters Patent is hereby corrected as shown below:

Column 5, line 31, change "ravelling" to --travelling--.

Signed and Sealed this

*Fifteenth* Day of *December 1981*

[SEAL]

*Attest:*

GERALD J. MOSSINGHOFF

*Attesting Officer*

*Commissioner of Patents and Trademarks*